US005598703A

United States Patent [19]

Hamburg et al.

[11] Patent Number: 5,598,703

[45] Date of Patent: Feb. 4, 1997

[54] AIR/FUEL CONTROL SYSTEM FOR AN INTERNAL COMBUSTION ENGINE

[75] Inventors: Douglas R. Hamburg, Bloomfield Hills; Dennis C. Reed, Plymouth, both of Mich.

[73] Assignee: Ford Motor Company, Dearborn, Mich.

[21] Appl. No.: 559,960

[22] Filed: Nov. 17, 1995

[51] Int. Cl.[6] ..... F01N 3/00

[52] U.S. Cl. ..... 60/285; 60/274

[58] Field of Search ..... 60/285, 276, 294

[56] References Cited

U.S. PATENT DOCUMENTS

| | | | |
|---|---|---|---|
| 5,211,011 | 5/1993 | Nishikawa et al. . | |
| 5,426,935 | 6/1995 | Ogawa | 60/285 |
| 5,473,888 | 12/1995 | Douta et al. | 60/276 |
| 5,492,094 | 2/1996 | Cullen et al. | 60/285 |
| 5,499,500 | 3/1996 | Hamburg et al. | 60/285 |
| 5,528,899 | 6/1996 | Ono | 60/285 |
| 5,537,816 | 7/1996 | Ridgway et al. | 60/285 |
| 5,544,481 | 8/1996 | Davey et al. | 60/274 |

*Primary Examiner*—John T. Kwon
*Attorney, Agent, or Firm*—Allan J. Lippa

[57] ABSTRACT

An air/fuel control system having a feedback variable generated by modulating fuel flow into the engine, generating an error signal from a difference between the average of an exhaust gas oxygen sensor output and a reference value correlated with a desired air/fuel ratio, and integrating the error signal. The reference value is periodically offset in both lean and rich air/fuel directions. A biasing signal is generated from an exhaust gas oxygen sensor position downstream of the converter in response to the air/fuel offset. After removing the offset from the reference value, the bias signal is applied thereto for centering engine air/fuel operation within the peak efficiency window of a catalytic converter.

10 Claims, 5 Drawing Sheets

AIR/FUEL CONTROL SYSTEM FOR AN INTERNAL COMBUSTION ENGINE

FIELD OF THE INVENTION

The present invention relates to air/fuel control systems for internal combustion engines equipped with catalytic converters.

BACKGROUND OF THE INVENTION

Air/fuel feedback control systems are known in which fuel flow is corrected by a feedback variable derived from an exhaust gas oxygen sensor in an effort to maintain stoichiometric combustion. A two-state oxygen sensor is typically used in which the change in output state occurs at a reference air/fuel ratio. The system includes a three way catalytic converter having a peak efficiency window for optimal catalytic conversion of hydrocarbons, carbon monoxide, and nitrogen oxides. Under ideal conditions, the transition in output state of the sensor and the peak efficiency window of the catalytic converter both occur at the stoichiometric air/fuel ratio.

The inventors herein have recognized numerous problems with the above approaches. For example, the transition in exhaust gas oxygen sensor output states may not occur at stoichiometry for all sensors or over the life of any particular sensor. Furthermore, the peak efficiency window may not occur at stoichiometry for all catalytic converters. Accordingly, engine air/fuel ratio may not occur at the converter's peak efficiency window, thus resulting in less than optimal conversion of engine exhaust.

SUMMARY OF THE INVENTION

An object of the invention claimed herein is to bias air/fuel feedback control to maintain engine air/fuel operation within the peak efficiency window of a catalytic converter while the feedback control is operating.

The above object is achieved, and problems of prior approaches overcome, by an air/fuel control method for an engine responsive to first and second exhaust gas oxygen sensors positioned in the engine exhaust respectively upstream and downstream of a catalytic converter, comprising the steps of: modulating an engine fuel flow signal; correcting the fuel flow signal by a feedback variable derived from the first sensor to cause engine air/fuel operation near a desired air/fuel ratio; offsetting the fuel flow signal by a first value during a first predetermined time to cause a corresponding rich offset in engine air/fuel operation and offsetting the fuel flow signal during a second predetermined time by a second value to cause a corresponding lean offset in engine air/fuel operation; and biasing the fuel flow signal with a rich fuel bias when the second sensor indicates excessively lean engine exhaust in response to the lean fuel offset and biasing the fuel flow signal with a lean fuel bias when the second sensor indicates excessively rich exhaust gases in response to the rich fuel offset.

An advantage of the above aspect of the invention is that engine air/fuel operation is maintained within the peak efficiency window of a catalytic converter while air/fuel feedback control is operating.

BRIEF DESCRIPTION OF THE DRAWINGS

The object and advantages described herein will be more fully understood by reading the following example of an embodiment in which the invention is used to advantage with reference to the drawings wherein.

DESCRIPTION OF AN EMBODIMENT

Figure 1:
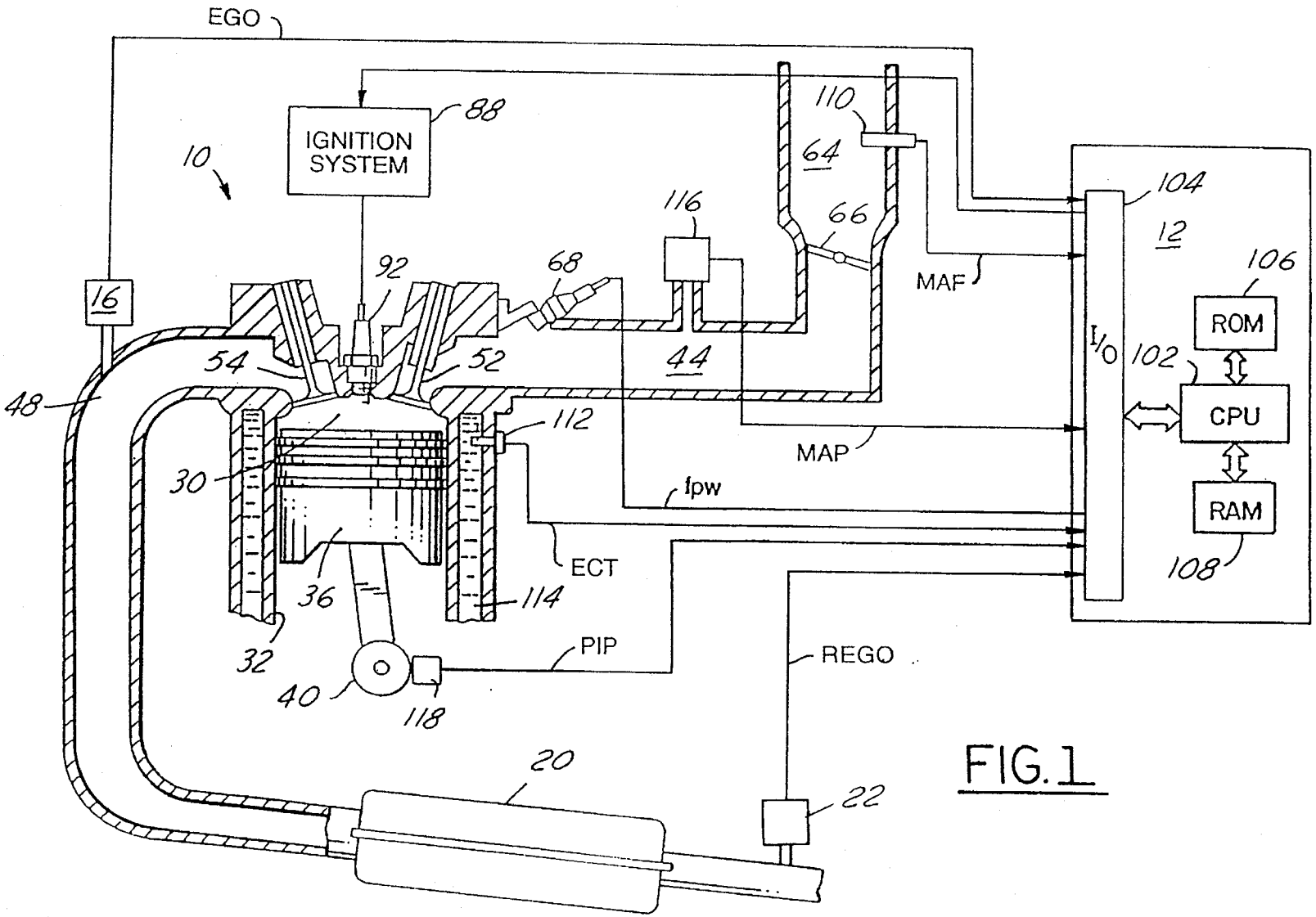
FIG. 1 is a block diagram of an embodiment in which the invention is used to advantage.

Internal combustion engine 10 comprising a plurality of cylinders, one cylinder of which is shown in FIG. 1, is controlled by electronic engine controller 12. Catalytic type exhaust gas oxygen sensors 16 and 22 are shown coupled to exhaust manifold 48 of engine 10 respectively upstream and downstream of catalytic converter 20. Sensors 16 and 22 respectively provide signals EGO and REGO to controller 12. Signal EGO is converted by controller 12 into two-state signal EGOS. A high voltage state of signal EGOS indicates exhaust gases are rich of a desired air/fuel ratio which is typically the stoichiometric air/fuel ratio and a low voltage state of signal EGOS indicates exhaust gases are lean of the reference air/fuel ratio. In general terms which are described later herein with particular reference to FIGS. 2–6, controller 12 provides engine air/fuel feedback control in response to signals EGOS and REGO for centering engine air/fuel ratio within the actual peak efficiency window of converter 20.

Continuing with FIG. 1, engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54.

Intake manifold 44 is shown communicating with throttle body 64 via throttle plate 66. Intake manifold 44 is also shown having fuel injector 68 coupled thereto for delivering liquid fuel in proportion to the pulse width of signal fpw from controller 12. Fuel is delivered to fuel injector 68 by a conventional fuel system (not shown) including a fuel tank, fuel pump, and fuel rail.

Conventional distributorless ignition system 88 provides ignition spark to combustion chamber 30 via spark plug 92 in response to controller 12.

Controller 12 is shown in FIG. 1 including: microprocessor unit 102, input/output ports 104, electronic memory 106, having computer readable code encoded therein, which is an electronically programmable memory chip in this particular example, random access memory 108, and a conventional data bus. Controller 12 is shown receiving various signals from sensors coupled to engine 10, in addition to those signals previously discussed, including: measurements of inducted mass air flow (MAF) from mass air flow sensor 110 coupled to throttle body 64; engine coolant temperature (ECT) from temperature sensor 112 coupled to cooling sleeve 114; a measurement of manifold pressure (MAP) from manifold pressure sensor 116 coupled to intake manifold 44; and a profile ignition pickup signal (PIP) from Hall effect sensor 118 coupled to crankshaft 40.

Figure 2:
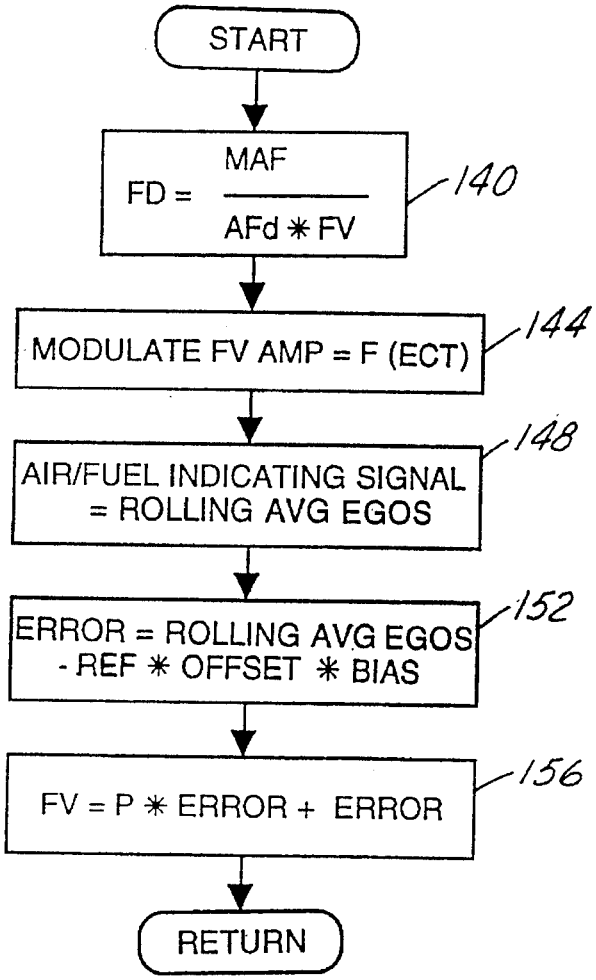
FIGS. 2 and 5 are flow charts of various operations performed by a portion of the embodiment shown in FIG. 1.

A description of various air/fuel operations performed by controller 12 is now commenced with initial reference to the flow charts shown in FIG. 2. Desired fuel quantity Fd is generated during step 140 which corresponds to the amount of liquid fuel to be delivered to engine 10. More specifically, desired fuel quantity signal Fd is generated by dividing the product of desired air/fuel ratio AFd and feedback variable FV into measurement of inducted mass air flow MAF times a correction value (not shown). Feedback variable FV is modulated during step 144 by a periodic signal. In this particular example, the periodic signal is selected as a triangular wave (see FIG. 3E). The peak to peak amplitude of the periodic signal is established as a function of engine coolant temperature ECT to provide a relatively constant exhaust air/fuel amplitude as engine 10 warms up.

A rolling average of signal EGOS is generated during step 148. Error signal ERROR is generated during step 152 by subtracting the product of reference signal REF times signal OFFSET, times signal BIAS from the rolling average of signal EGOS (152). Typically, the amplitude of signal REF is selected at a value (such as 0.5) corresponding to a fifty percent duty cycle of signal EGOS which should correspond to a stoichiometric air/fuel ratio. The effective air/fuel ratio reference is shifted when either signal OFFSET or signal BIAS are at a value other than unity. Accordingly, engine air/fuel ratio is shifted from stoichiometry when either signal OFFSET or signal BIAS are at a value other than unity.

Feedback variable FV is generated by applying a proportional plus integral (PI) controller to signal ERROR as shown in step 156. More specifically, signal ERROR is multiplied by proportional gain value P and the product added to the integral of signal ERROR.

Figure 3A:
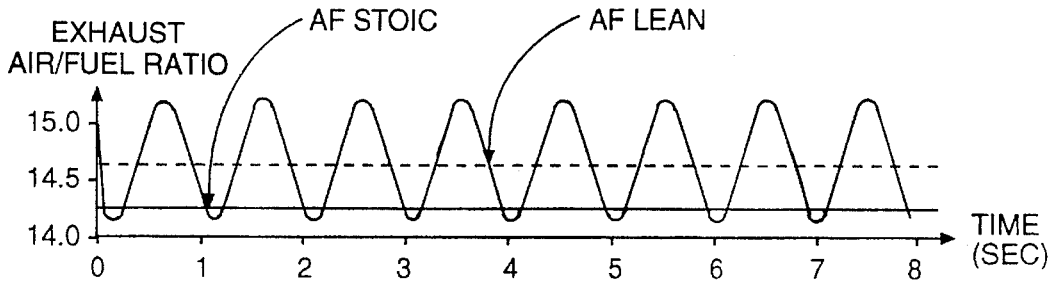
Figure 3B:
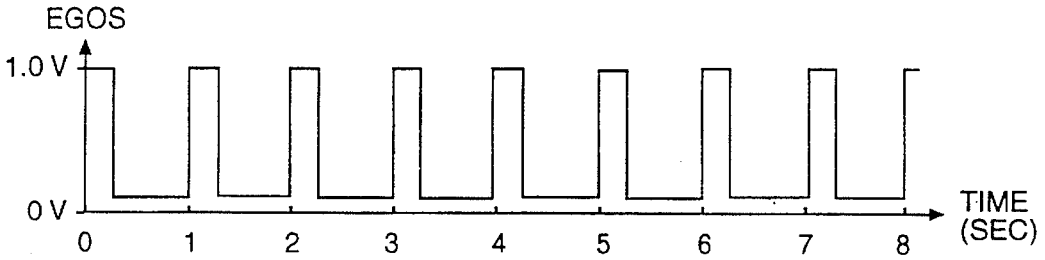
Figure 3C:
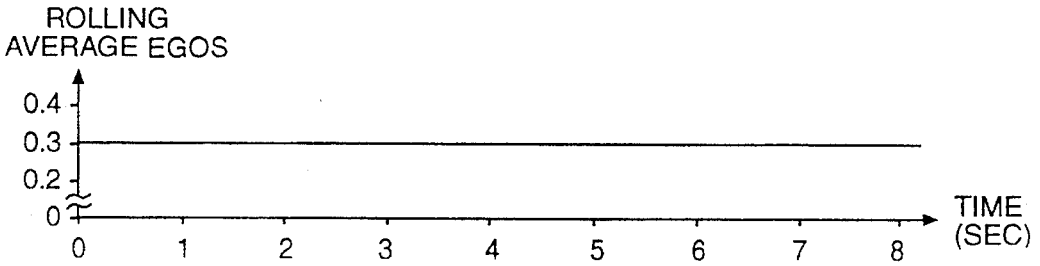
Figure 3D:
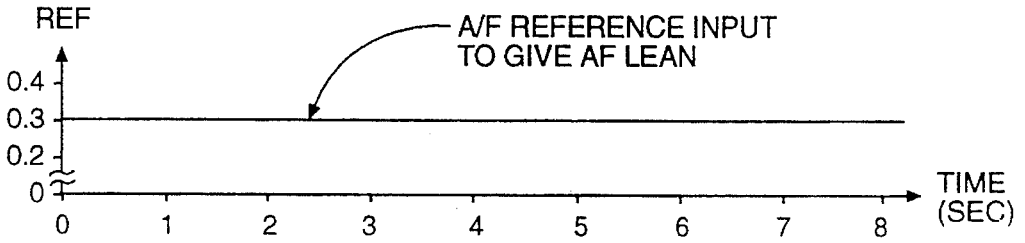
Figure 3E:
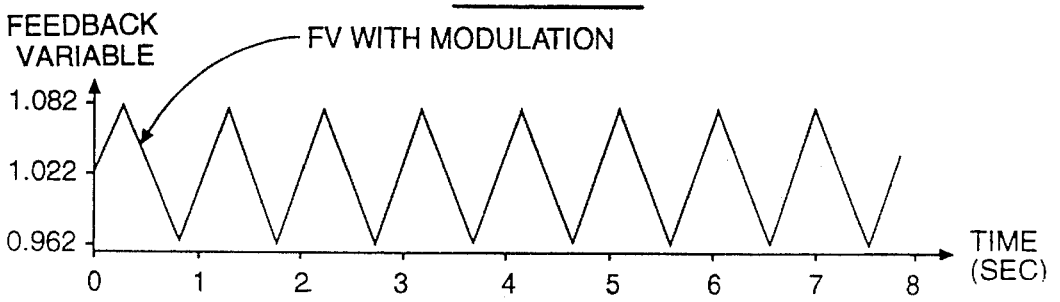

The operation and advantageous effects of steps 140–156 will be better understood by reviewing an example of operation with particular reference to the waveforms shown in FIGS. 3A–3E and FIG. 4. In this particular example which depicts steady state lean air/fuel operation, reference signal REF is set to lean value REFLEAN (see FIG. 3D) to provide an average air/fuel ratio lean of stoichiometry while feedback variable FV is being modulated with a triangular wave (FIG. 3E).

In this particular example, the effect of such modulation and selection of lean reference value REFLEAN for reference signal REF provides the exhaust air/fuel ratio shown in FIG. 3A. The average value of this air/fuel ratio is shown as the dashed line labeled AFLEAN which is lean of the stoichiometric air/fuel ratio labeled AFSTOIC. Corresponding signal EGOS from sensor 16 is shown in FIG. 3B wherein a high voltage state is indicative of air/fuel operation rich of stoichiometry and a low voltage state is indicative of air/fuel operation lean of stoichiometry The rolling average of signal EGOS, which is the air/fuel indicating signal, is shown in FIG. 3C. In this example showing steady state operation, the rolling average of signal EGOS (FIG. 3C) is forced to the same value as lean reference value REFLEAN (FIG. 3D).

Figure 4:
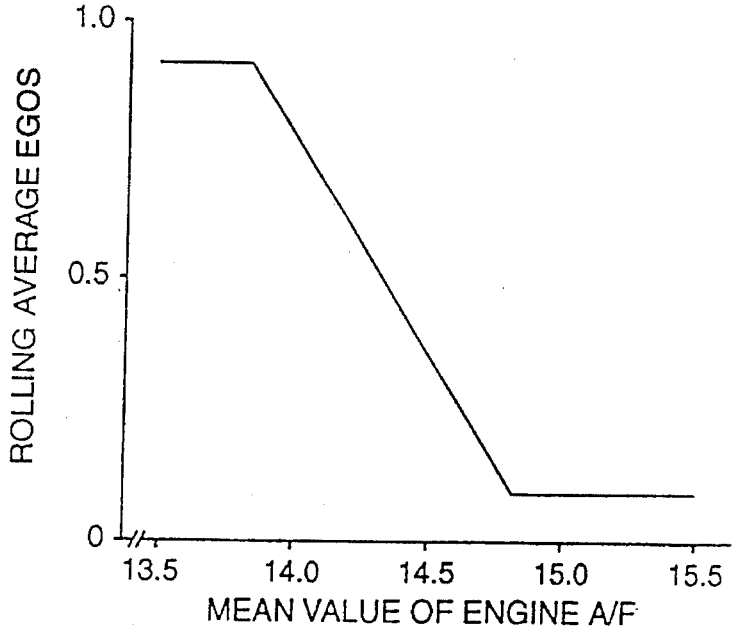
FIGS. 3A–3E, 4, and 6 illustrates various waveforms associated with the embodiment shown in FIG. 1.

Referring to FIG. 4, a hypothetical graphical representation of the rolling average of signal EGOS, which is the air/fuel indicating signal, in relation to the average engine air/fuel ratio is shown. It is seen that an advantage of the invention claimed herein is that a linear air/fuel indicating signal is provided from a two-state exhaust gas oxygen sensor. In this particular example, the air/fuel indicating signal is used to operate engine 10 at an average value lean of stoichiometry using accurate feedback control.

Figure 5:
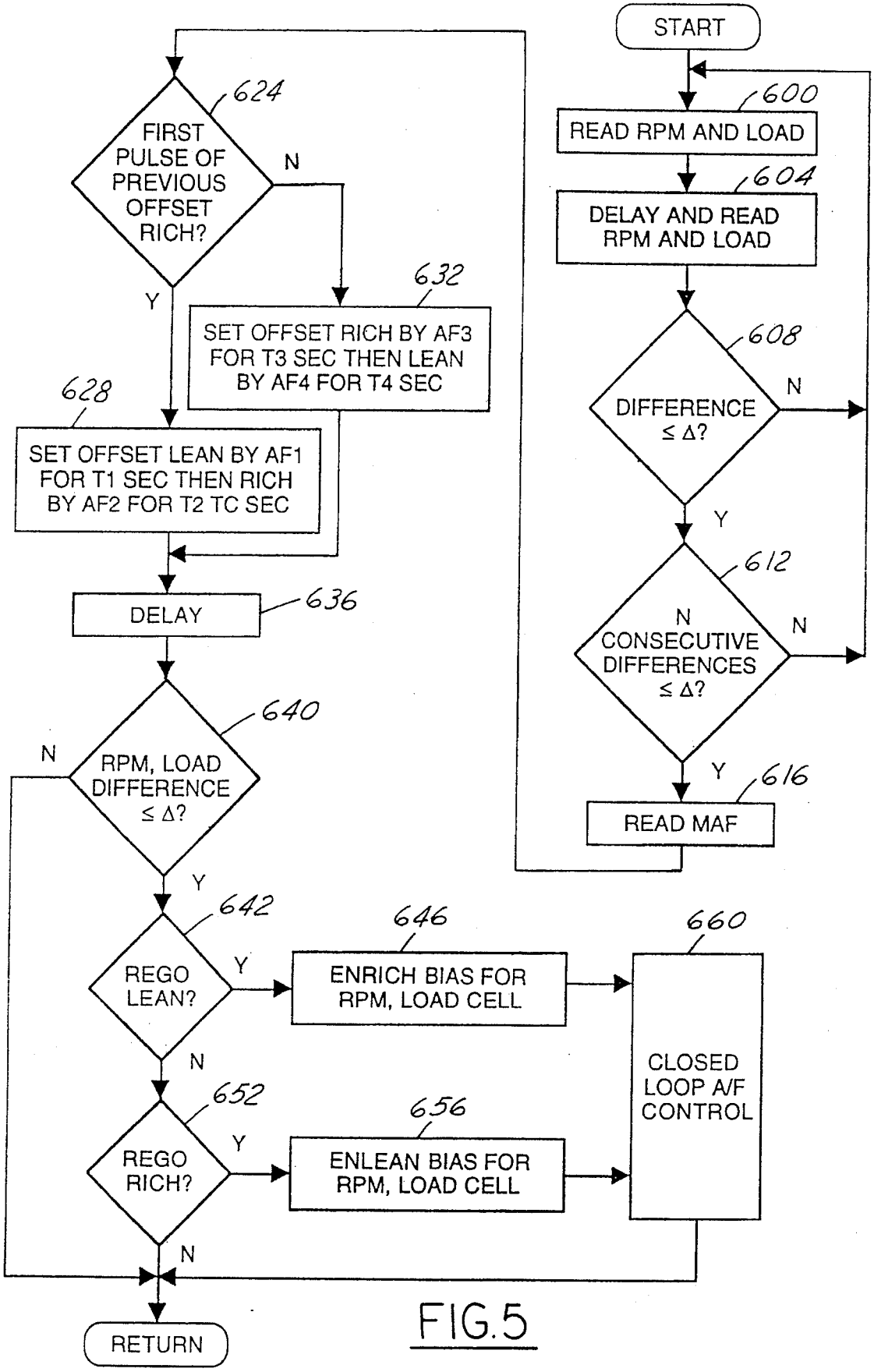
Figure 6:
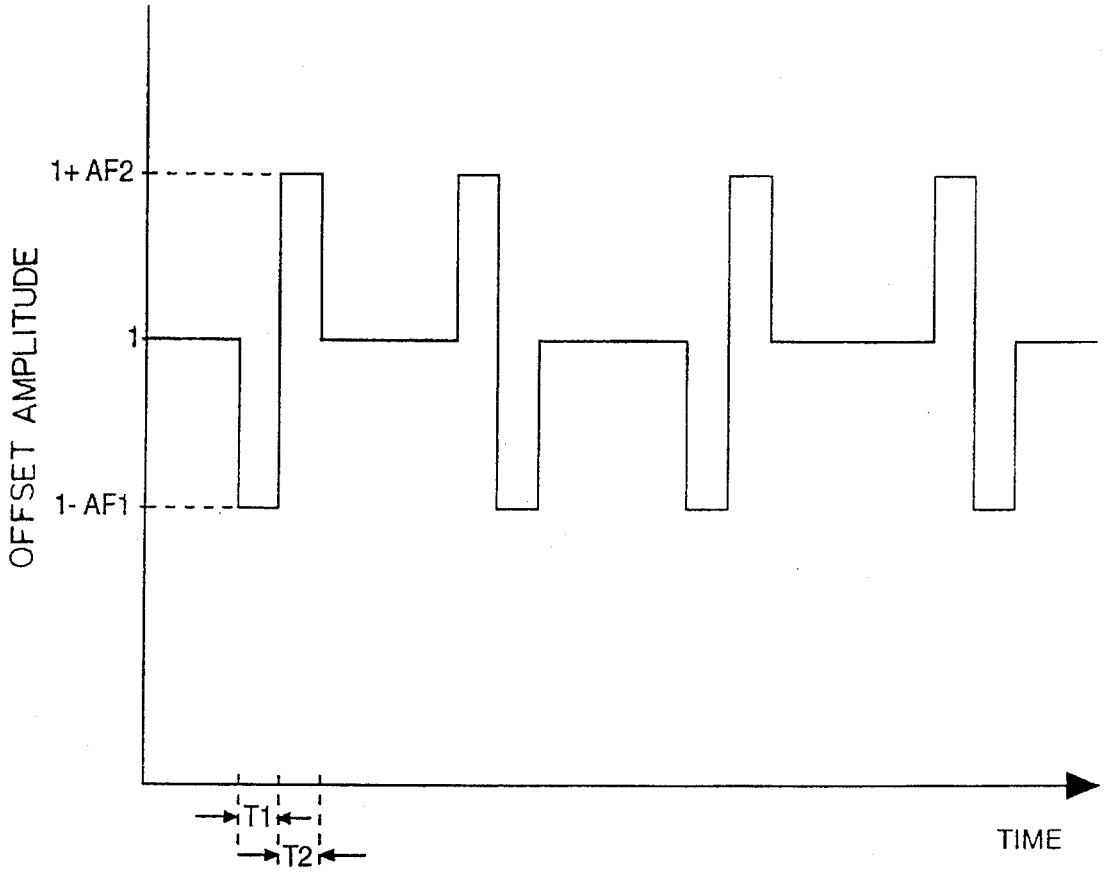

The subroutine for biasing engine air/fuel operation to center the engine air/fuel ratio within the peak efficiency window of catalytic converter 20 is now described with particular reference to FIG. 5. In general, average air/fuel ratio is periodically offset lean and periodically offset rich by offsetting signal REF with signal OFFSET. In this particular example, the offset is provided by multiplying signal REF with signal OFFSET as shown in step 152 of FIG. 2.

Continuing with FIG. 5, when downstream exhaust gas oxygen sensor 22 indicates the air/fuel offset has not been totally removed by converter 20, the offset is removed from signal REF and signal REF is biased with an appropriate air/fuel bias value to bias the operating air/fuel ratio within the peak efficiency window of converter 20. In this particular example, the bias is provided by multiplying signal REF with signal BIAS as shown in step 152 of FIG. 2. Because bias values are generated for each of a plurality of engine rpm and load cells, the subroutine first determines when engine 10 is operating in a particular rpm, load cell for a preselected time.

Engine rpm and load are read during step 600, read again during step 604 after a preselected delay time, and the difference between successive rpm and load values determined in step 608. When these differences are less than a preselected value (Δ) for "N" consecutive trials (612), the subroutine for generating signal BIAS described below commences.

A measurement of airflow (MAF) inducted into engine 10 is read during step 616. Signal OFFSET is then generated as shown by the waveform illustrated in FIG. 6. When signal OFFSET is at unity, no air/fuel offset is provided. In general, signal OFFSET is modulated between a lean offset and a rich offset to determine whether the resulting excursion in exhaust emissions has exceeded the peak efficiency window of catalytic converter 20. Such an indication is provided by downstream exhaust gas oxygen sensor 22 a predetermined time after the offset is provided. This predetermined time is substantially equal to the time required for an air/fuel mixture to propagate through engine 10, exhaust manifold 48, and catalytic converter 20 to exhaust gas oxygen sensor 22.

Continuing with FIG. 5, when the first pulse of the previous signal OFFSET was rich (624), signal OFFSET is set lean by amplitude AF1 for T1 seconds (628). Immediately thereafter, signal OFFSET is set rich by amplitude AF2 for T2 seconds to compensate for the effect of the lean offset. Downstream exhaust gas oxygen sensor 22 is read (642 and 652) after the predetermined delay time following introduction of the lean offset (636), provided that engine rpm and load remain within deviation Δ of the previous rpm and load values (640). If the lean offset is detected by downstream exhaust gas sensor 22, signal REGO will indicate a lean value (642) and the signal BIAS for this particular rpm and load cell will be incrementally enriched (step 646).

Operation proceeds in a similar manner when a rich offset is provided by signal OFFSET. More specifically, during step 632, signal OFFSET is offset rich by amplitude AF3 for T3 seconds. Immediately thereafter, signal OFFSET is reset by a lean offset (AF4) for T4 seconds to counteract the effect of the rich offset (632). Downstream exhaust gas oxygen sensor 22 is then sampled during step 652 after a delay time (636) correlated with propagation of the rich offset in air/fuel mixture through engine 10, exhaust manifold 48, and catalytic converter 20, provided that engine rpm and load have not changed by more than difference Δ. If the rich offset is detected by output signal REGO from downstream sensor 22 (652), signal BIAS is incrementally enleaned for this particular speed and load cell in step 656.

This concludes the description of an embodiment in which the invention is used to advantage. The reading of it by those skilled in the art would bring to mind many alterations and modifications without departing from the spirit and scope of the invention. Accordingly, it is intended for the scope of the invention be limited by the following claims.

What is claimed:

1. An air/fuel control method for an engine responsive to first and second exhaust gas oxygen sensors positioned in the engine exhaust respectively upstream and downstream of a catalytic converter, comprising the steps of:

modulating an engine fuel flow signal;

correcting said fuel flow signal by a feedback variable derived from the first sensor to cause engine air/fuel operation near a desired air/fuel ratio;

offsetting said fuel flow signal by a first value during a first predetermined time to cause a corresponding rich offset in engine air/fuel operation and offsetting said fuel flow signal during a second predetermined time by a second value to cause a corresponding lean offset in engine air/fuel operation; and biasing said fuel flow signal with a rich fuel bias when the second sensor indicates excessively lean engine exhaust in response to said lean fuel offset and biasing said fuel flow signal with a lean fuel bias when the second sensor indicates excessively rich exhaust gases in response to said rich fuel offset.

2. The method recited in claim 1 wherein said feedback variable is generated by the steps of averaging the first sensor output to provide an air/fuel indicating signal having an amplitude related to engine air/fuel operation; selecting both a desired air/fuel ratio and a reference value corresponding to said desired air/fuel ratio; generating an error signal from a difference between said averaged sensor output and said reference value; and generating said feedback variable from said error signal.

3. The method recited in claim 2 wherein said offsetting step comprises offsetting said reference value by said first value and said second value.

4. The method recited in claim 3 wherein said biasing step comprises removing said first value and said second value from said reference and adding said rich fuel bias and said lean fuel bias to said reference.

5. The method recited in claim 1 wherein said fuel flow signal has an amplitude proportional to an indication of inducted airflow.

6. The method recited in claim 1 wherein said second value offsetting step follows said first value offsetting step by a third predetermined time.

7. The method recited in claim 1 wherein said first predetermined and said second predetermined times are a function of an indication of airflow inducted into the engine.

8. An air/fuel control method for an engine responsive to first and second exhaust gas oxygen sensors positioned in the engine exhaust respectively upstream and downstream of a catalytic converter, comprising the steps of:

generating a fuel flow signal having an amplitude proportional to an indication of inducted airflow to cause engine air/fuel operation near a desired air/fuel ratio;

correcting said fuel flow signal by a feedback variable derived from the first sensor;

modulating said fuel flow signal;

offsetting said fuel flow signal by a first value during a first predetermined time to cause a corresponding rich offset in engine air/fuel operation and immediately thereafter offsetting said fuel flow signal in a lean air/fuel direction to cancel said rich offset, and offsetting said fuel flow signal during a second predetermined time by a second value to cause a corresponding lean offset in engine air/fuel operation and immediately thereafter offsetting said fuel flow signal in a rich air/fuel direction to cancel said lean offset; and biasing said fuel flow signal with a rich fuel bias when the second sensor indicates excessively lean engine exhaust in response to said lean fuel offset and biasing said fuel flow signal with a lean fuel bias when the second sensor indicates excessively rich exhaust gases in response to said rich fuel offset.

9. The method recited in claim 8 wherein said second value offsetting step follows said first value offsetting step by a third predetermined time.

10. The method recited in claim 7 wherein said first predetermined and said second predetermined times are a function of an indication of airflow inducted into the engine.

* * * * *